US005972136A

United States Patent [19]

Wagaman

[11] Patent Number: 5,972,136

[45] Date of Patent: Oct. 26, 1999

[54] LIQUID PROPELLANT

[75] Inventor: Kerry L. Wagaman, Bryantown, Md.

[73] Assignee: The United States of America as represented by the Secretary of the Navy, Washington, D.C.

[21] Appl. No.: 08/854,031

[22] Filed: May 9, 1997

[51] Int. Cl.[6] ..... C06B 31/28

[52] U.S. Cl. ..... 149/46

[58] Field of Search ..... 149/74, 46

[56] References Cited

U.S. PATENT DOCUMENTS

| | | | |
|---|---|---|---|
| 3,164,503 | 1/1965 | Gehrig | 149/74 |
| 3,230,700 | 1/1966 | Larsen | 149/74 |
| 3,282,754 | 11/1966 | Gehrig | 149/46 |
| 4,004,415 | 1/1977 | Wood | 149/74 |
| 4,047,988 | 9/1977 | Weill et al. | 149/74 |
| 4,357,856 | 11/1982 | Wood et al. | 149/74 |
| 5,223,057 | 6/1993 | Mueller et al. | 149/46 |
| 5,574,240 | 11/1996 | Cartwright | 149/46 |

*Primary Examiner*—Edward A. Miller
*Attorney, Agent, or Firm*—John Forrest; Roger D. Johnson

[57] ABSTRACT

A liquid oxidizer for propellants or explosives comprising nitric acid ($HNO_3$), ammonium nitrate ($NH_4NO_3$), and water.

3 Claims, No Drawings

LIQUID PROPELLANT

BACKGROUND

This invention relates to oxidizers and more particularly to liquid oxidizers for explosives and propellants.

Many factors such as cost, energy, safety characteristics, physical properties, and chemical properties are involved in the determination of an appropriate liquid oxidizer for explosive and propellant compositions. The objective is to balance those factors and intended results so that the liquid oxidizer can be mixed with materials to form explosive or propellant compositions and achieve the desired results. Cost and adverse safety characteristics of the ingredients in explosive or propellant compositions is usually directly proportional to the energy of the system. However, it is desirable to minimize the impact of these factors and maximize the energy of the compositions.

The most effective liquid oxidizer presently used in the propellant compositions is inhibited, red, fuming, nitric acid (IRFNA), which produces excellent energy and performance as a component of the propellant compositions. However, IRFNA is very toxic and extremely corrosive, which increases the cost of the systems hardware in which it is used; IRFNA's corrosiveness has resulted in system leakage causing damage to the weapons or other systems and personnel injures.

SUMMARY

Accordingly, an object of this invention is to provide new energetic liquid oxidizers for explosives and propellants.

Another object of this invention is to provide less expensive liquid oxidizers for propellants and explosives.

A further object of this invention is to provide energetic liquid explosive and propellant oxidizers that are less corrosive and easier to handle than the concentrated hydrogen peroxide and fuming red or white nitric acids presently in use.

These and other objects of this invention are achieved by providing solutions comprising nitric acid, ammonium nitrate, and water.

DESCRIPTION

The liquid oxidizers of this invention are solutions of nitric acid ($HNO_3$), ammonium nitrate ($NH_4NO_3$), and water. They are referred to as ANNA (ammonium nitrate-nitric acid) oxidizers. The oxidizers form two classes: (1) concentrated (or high energy ) ANNA oxidizers and (2) dilute (or lower energy) ANNA oxidizers. The concentrated ANNA oxidizers are useful as oxidizers for liquid gun propellants or liquid explosives. The dilute ANNA oxidizers may be used as oxidizers for liquid propellants for air bags, torpedoes, and aircraft carrier catapults systems.

The concentrated ANNA oxidizers comprise nitric acid ($HNO_3$), ammonium nitrate, and water in the following proportions. The $HNO_3$ comprises preferably from about 30 to about 95 and more preferably from 50 to 81 weight percent of the concentrated liquid oxidizer. Nitric acid or $HNO_3$ here refers to the pure compound (100%) $HNO_3$. The ammonium nitrate comprises preferably from 5 to about 40 and more preferably from 10 to 30 weight percent of the concentrated liquid oxidizer. The water comprises preferably from about 8 to about 30 and more preferably from 8 to 20 weight percent of the concentrated liquid oxidizer. The water may be sea water, but preferably it will be fresh water, and still more preferably it will be distilled water.

Examples of three specific preferred concentrated liquid oxidizer formulations are 10-90 ANNA (10% $NH_4NO_3$, 81% $HNO_3$, 9% $H_2O$), 30-40 ANNA (30% $NH_4NO_3$, 40% $HNO_3$, 30% $H_2O$), and 28-52 ANNA (28% $NH_4NO_3$, 52% $HNO_3$, 20% $H_2O$). These oxidizers are less expensive and considerably safer to handle than inhibited fuming red nitric acid (IRFNA) which is conventionally used. As illustrated by the theoretical calculations in examples 1 through 3, the 10-90 ANNA produces propellants having about the same energy as those produced by IRFNA. The calculations in examples 1 and 2 show that 28-52 ANNA produces propellants having somewhat less energy than those produced with IRFNA. Nevertheless, both the 30-40 ANNA and the 28-52 ANNA propellants have enough energy to be useful for the same applications. The 30-40 ANNA and 28-52 ANNA concentrated liquid oxidizers are preferred embodiments because combine good oxidation power with safe handling characteristics. Of these 28-52 ANNA concentrated liquid oxidizer is the most preferred embodiment. If 28-52 ANNA oxidizer is washed from the skin with water within a few minutes of contact, damage or irritation to the skin will be minimized.

The dilute ANNA oxidizers comprise nitric acid ($HNO_3$), ammonium nitrate, and water in the following proportions. The $HNO_3$ comprises preferably from about 5 to about 80 and more preferably from 5 to 50 weight percent of the dilute liquid oxidizer. Nitric acid or $HNO_3$ here refers to the pure compound (100%) $HNO_3$. The ammonium nitrate comprises preferably from about 3 to about 50 and more preferably from 16 to 45 weight percent of the dilute liquid oxidizer. The water comprises preferably from about 20 to about 80 and more preferably from 20 to 65 weight percent of the dilute liquid oxidizer. The water may be sea water, but preferably it will be fresh water, and still more preferably it will be distilled water.

The ANNA liquid oxidizers have good thermal stabilities. Differential thermal analysis supports the thermal stability of the ANNA liquid oxidizers. Exothermic decomposition of 10-90 ANNA does not occur until about 160° C., whereas 28-52 ANNA undergoes exothermic decomposition at about 140° C. The thermal analysis values are determined by placing thermocouple connections in a control sample and in the desired test material and then slowly heating the test material. Differences in temperatures are an indication of an exothermal or endothermal reaction taking place in the test material.

The 10-90 ANNA and 28-52 ANNA liquid oxidizers that were tested for thermal stability were also tested for sensitivity by a cavity drop test. This test is designed to determine the ease of initiation of detonation by adiabatic compression of air bubbles which may be present in a liquid explosive. In this test 0.03 ml of a liquid explosive (or in this case energetic liquid oxidizer) is put into a cavity in a steel cup. The cavity is sealed by an O-ring and a thin-steel diaphragm. A weight is allowed to fall on the pin resting on the steel diaphragm. The test result is expressed as the minimum product of height and weight necessary to cause detonation. The 10-90 ANNA and 28-52 ANNA liquid oxidizers tested at greater than 100 kilogram centimeter, indicating that those oxidizers are insensitive.

It is desirable to know or to be able to predict the densities of prospective oxidizers because the densities are used to calculate the density impulse energy output (density times impulse). Computer codes have been developed to predict the densities of various oxidizers. However, these prior art codes have been developed for solid oxidizers for solid propellants. When these codes have been applied to liquid oxidizers, the calculated densities have been as much as 30 percent off from the measured densities. Unlike solid propellant oxidizers where only minimal dissolution of ingredients occur, liquid propellant oxidizers, not only will have binary solubilities, but also the other ingredients will act as co-solubilizers or solubility inhibitors for these mixtures. Moreover, the ingredients of the liquid mixture will solubilize in one another with unpredictable formulation densities. Also the temperature coefficients of expansion and the co-solubilities of ingredients for liquids is much greater.

Since combustion design engineers have a need for accurate methods of predicting the densities of the ammonium nitrate-nitric acid-water (ANNA) liquid oxidizer solutions of this invention, the following method is provided. Table 1 summarizes the experimental density measurements for various ANNA solutions.

TABLE 1

Densities of Aqueous solutions of Ammonium Nitrate and Nitric Acid

| Ammonium[1] nitrate | Nitric Acid[1] | Water[1] | Density |
|---|---|---|---|
| 0.477 | 0.0 | 0.523 | 1.21 |
| 0.428 | 0 | 0.572 | 1.19 |
| 0.386 | 0 | 0.614 | 1.17 |
| 0.26 | 0 | 0.74 | 1.11 |
| 0.127 | 0 | 0.873 | 1.05 |
| 0 | 0.30 | 0.70 | 1.168 |
| 0.05 | 0.29 | 0.67 | 1.186 |
| 0.09 | 0.27 | 0.64 | 1.202 |
| 0.13 | 0.26 | 0.61 | 1.216 |
| 0.17 | 0.25 | 0.58 | 1.231 |
| 0.20 | 0.24 | 0.56 | 1.24 |
| 0.23 | 0.23 | 0.54 | 1.251 |
| 0.26 | 0.22 | 0.52 | 1.262 |
| 0.29 | 0.21 | 0.50 | 1.268 |
| 0 | 0.40 | 0.60 | 1.239 |
| 0.05 | 0.38 | 0.57 | 1.253 |
| 0.11 | 0.36 | 0.54 | 1.27 |
| 0.13 | 0.35 | 0.52 | 1.278 |
| 0.17 | 0.33 | 0.50 | 1.288 |
| 0.20 | 0.32 | 0.48 | 1.298 |
| 0.23 | 0.31 | 0.46 | 1.307 |
| 0.26 | 0.30 | 0.44 | 1.316 |
| 0.29 | 0.29 | 0.43 | 1.324 |
| 0 | 0.23 | 0.77 | 1.106 |
| 0.05 | 0.19 | 0.76 | 1.126 |
| 0.09 | 0.18 | 0.73 | 1.144 |
| 0.13 | 0.17 | 0.7 | 1.162 |
| 0.17 | 0.17 | 0.67 | 1.174 |
| 0.20 | 0.16 | 0.64 | 1.188 |
| 0.24 | 0.15 | 0.61 | 1.202 |
| 0.26 | 0.15 | 0.59 | 1.212 |
| 0.29 | 0.14 | 0.57 | 1.223 |

[1]Composition given in weight fractions

The density data points from table 1 have been used to fit the following quadratic equation:

$$\text{Density in g/cc}=1.355(AN)+1.722(NA)+0.976(Water)+0.188(AN)(NA)+0.211(AN)(WATER)-0.173(NA)(WATER)$$

where

AN=the weight fraction of ammonium nitrate in the test solution,

NA=the weight fraction of nitric acid in the test solution, and

WATER=the weight fraction of water in the test solution.

The following example uses this equation to calculate the density of 28-52 ANNA (28% ammonium nitrate, 52% nitric acid, and 20% water).

28-52 ANNA:

AN=0.28

NA=0.52

Water=0.20

$$\text{Density}=(1.355)(0.28)+(1.722)(0.52)+(0.976)(0.20)+(0.188)(0.28)(0.52)+(0.211)(0.28)(0.20)-(0.173)(0.52)(0.20)$$
$$=0.374+0.895+0.195+0.027+0.012-0.018$$
$$=1.484 \text{ g/cc}$$

Experimental value of 28-52 ANNA's density is 1.462 g/cc.

Differences between the experimental and calculated value for density will be greater for the more concentrated (less water) solutions than for the diluted oxidizer solutions. However, these calculated values will be satisfactory for preliminary combustion engineering designs and will be far superior to computer code calculated values.

Replacing inhibited red fuming nitric acid (IRFNA) or white fuming nitric acid (WFNA) oxidizers with the liquid oxidizers of this invention can be used to reduce corrosion of the weapons systems. Table 2 presents test data comparing the corrosion rates of WFNA and IRFNA with that of 10-90 ANNA on stainless steels and other metallic materials which are commonly used in weapons systems.

TABLE 2

Corrosion Rates[1] for Various Solutions[2]

| Material | WFNA[3] | 10-90 ANNA[4] | IRFNA[5] |
|---|---|---|---|
| Zirconium | −0.3 | 0 | 40.4 |
| Stainless Steel Alloys: | | | |
| AISI type 304 | 80.0 | 1.2 | 1.3 |
| AISI type 316 | 25.5 | 3.4 | 3.9 |
| 20 CB3 | 9.7 | 1.9 | — |
| Carbon Steels: | | | |
| 17-4 | 37.5 | 3.1 | 4.7 |
| 15-5 | 39.5 | 3.2 | 4.3 |
| 13-8 Mo | 68.7 | 3.3 | 5.6 |
| 13-8 Mo PH | 43.6 | 3.9 | 5.1 |
| Nonferrous alloys: | | | |
| Hastelloy B | — | 1620 | — |
| Hastelloy C | — | 0.8 | — |
| Hastelloy X | — | 0.6 | — |
| Rene' 41 | — | 1.5 | — |

[1]Values are in milli inches per year
[2]Approximately ten days exposure at room temperature
[3]White fuming nitric acid
[4](10% $NH_4NO_3$, 81% $HNO_3$, 9% $H_2O$)
[5]Inhibited red fuming nitric acid The ANNA liquid oxidizers are prepared by mixing the desired amounts of ammonium nitrate, nitric acid, and water together at ambient temperature until the solid ammonium nitrate has totally dissolved into the nitric acid-water ($HNO_3$—$H_2O$) solution to form the desired ammonium nitrate-nitric acid-water ($NH_4NO_3$—$HNO_3$—$H_2O$) solution.

The ANNA liquid oxidizers of this invention disperse readily with conventional liquid fuels such as JP-4, JP-5, JP-10, Otto fuel II, and MAF-4 to produce propellants. In-line static mixers or the turbulent flow in pumps or swirl-section of injector spray nozzles will mechanically produce fine-droplet dispersions of these oil-like fuels in these water-based oxidizers. Emulsifying agents may also be added to improve the dispersibility of these liquids; examples are anionic surfactants, such as sodium alcohol sulfates, or nonionic surfactants, such as sorbitan fatty acid esters. Although the mixture of the liquid oxidizer and fuel may be safely stored, the safety/vulnerability is improved by storing the liquid oxidizer alone and then mixing it with the fuel as needed.

Aircraft carrier catapults may also be powered by combusion of propellants formed by mixing a fuel with an oxidizer which is a solution of ammonium nitrate ($NH_4NO_3$) water ($H_2O$). Fuels which may be used include conventional jet fuels such as JP-4, JP-5, JP-8, and JP-10. The oxidizer will comprise preferably from 20 to 60 and more preferably from 25 to 55 weight percent ammonium nitrate and preferably from 40 to 80 and more preferably from 45 to 75 weight percent water. These aqueous solutions of ammonium nitrate are insensitive to impact (bullets, shrapnel) and have good cook off properties in a fire. These low cost solutions also have low toxicity and corrosiveness. If the solution splashes or spills on a sailor, the solutions can be wash off with water without harm to the sailor.

Naval Air Warfare Center, China Lake, Calif. The results of the performance calculations of the monopropellants are given in Table 3. Most computations are based on an expansion of the combustion gases from 1000 psi (chamber pressure) to 14.7 psi; exceptions are so indicated. Note that the method used to calculate the specific impulse ($I_{sp}$) is a conventional one widely used and understood in the propellant field. J. M. Mul et al. in "Search for New Storable High Performance Propellants," AIAA/ASME/SAE/ASEE 24th Joint Propulsion Conference, Jul. 11–13 1988, Boston, Mass., disclosure the basic method of calculating the theoretical specific impulse ($I_{sp}$) for propellants, and is herein incorporated by reference in its entirety.

The specific impulse of stoichiometric liquid propellants is mainly determined by the amount of water in the formulation. However, the type of fuel used in the propellant will influence the specific impulse to a small extent. Fuels consisting of compounds containing carbon-carbon multiple bonds or cyano groups such as butyne-1,4-diol or acetonitrile will give higher specific impulses than fuels consisting of ethers such as dioxane or polyethylene glycol. The latter, in turn, will yield higher energy than polyhydric alcohols, carboxylic acids, and their derivatives, such as glycerin, acetic acid, or dimethyl formamide.

As indicated earlier, only stoichiometric formulations were considered which yield steam, carbon dioxide, and nitrogen as combustion products. Deviations from the stoichiometry to fuel-rich or oxidizer-rich propellants will generally decrease the specific impulse and the amount of water-soluble and condensable exhaust gases.

TABLE 3

Theoretical Performance of Bipropellant Systems

| Example | Oxidizer | Fuel | I sp, sec. | I sp X density, gsec/cc | Exhaust Gas Temperature, K |
|---|---|---|---|---|---|
| 1 | IRNFA | MAF-4 | 267 | 374 | 3090 |
| 1 | 28-52 ANNA | " | 233 | 319 | 2396 |
| 1 | 10-90 ANNA | " | 266 | 370 | 3057 |
| 2 | IRFNA | Otto Fuel II | 260 | 360 | 3159 |
| 2 | 28-52 ANNA | " | 230 | 295 | 2467 |
| 2 | 10-90 ANNA | " | 258 | 351 | 3101 |
| 3 | IRFNA | 1,4-Dioxane | 266 | 362 | 3186 |
| 3 | 10-90 ANNA | " | 262 | 355 | 3093 |

Where IRFNA = inhibited red fuming nitric acid

The general nature of the invention having been set forth, the following examples are presented as specific illustrations thereof. It will be understood that the invention is not limited to these specific examples but is susceptible to various modifications that will be recognized by one of ordinary skill in the art.

All parts and percentages in the examples and the specification are by weight unless otherwise specified.

EXAMPLES 1 THROUGH 3

The energy content of several ANNA/fuel formulations and the corresponding IRFNA/fuel formulations were calculated by the use of a "Theoretical Performance and Specific Impulse Computer Program," obtained from the

EXAMPLES 4 THROUGH 11

Calculations of the theoretical detonation velocity and detonation pressure for mixtures of ANNA liquid oxidizers with several common organic materials are made and reported as examples 4, 5, 6, and 7 in table 4. For comparison the computer-calculated detonation velocity and detonation pressure for standard explosives PBXW-100 (example 8), nitroglycerin (NG) (example 9), trinitrotoluene (TNT) (example 10), and cyclotrimethylenetrinitramine (RDX) (example 11) are also presented in table 4. The theoretical detonation velocities and pressures are based on calculations made by using a modification of the work done by M. Kamlet and C. Jacobs which is reported in the Journal of Chemical Physics, (1968), volume 48, number 1, pages 23–35, herein incorporated by reference in its entirety.

TABLE 4

Theoretical Performance of Experimental and Conventional Explosives

| Example | Explosive | Detonation Velocity, m/sec | Detonation Pressure, Kbars |
|---|---|---|---|
| | 10-90 ANNA with Example 4–7 | | |
| 4 | 23% wt. tetramethylene glycol dimethyl ether | 7625 | 227 |
| 5 | 22.5% wt. 1,4-Dioxane | 7400 | 206 |
| 6 | 20.5% wt. Ethanol | 6850 | 198 |
| 7 | 20% wt. n-Octane | 7480 | 236 |
| 8 | PBXW-100 | 6200 | 156 |
| 9 | NG | 8000 | 250 |
| 10 | TNT | 6400–6900 | 193–205 |
| 11 | RDX | 8000 | 310 |

Obviously, other modifications and variations of the present invention may be possible in light of the foregoing teachings. It is therefore to be understood that within the scope of the appended claims the invention may be practiced otherwise than as specifically described.

What is claimed is:

1. A low temperature propellant for powering catapults for launching aircraft consisting essentially of:

A. a fuel that is a jet aircraft fuel; and

B. an oxidizer consisting essentially of (1) from 20 to 60 weight percent ammonium nitrate; and (2) from 40 to 80 weight percent water.

2. The propellant of claim 1 wherein the oxidizer consists essentially of from 25 to 55 weight percent ammonium nitrate and from 45 to 75 weight percent water.

3. The propellant of claim 1 wherein the jet fuel is JP-4, JP-5, JP-8, or JP-10.

* * * * *